US008046105B2

(12) United States Patent
Steffen et al.

(10) Patent No.: US 8,046,105 B2
(45) Date of Patent: Oct. 25, 2011

(54) VIBRATING PLATE SYSTEM

(75) Inventors: Michael Steffen, Munich (DE); Oliver Kolmar, Neubiberg (DE); Thorsten von Richthofen, Munich (DE); Thomas Lachenmaier, Pfaffenhofen (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 742 days.

(21) Appl. No.: 11/994,188

(22) PCT Filed: Jun. 30, 2006

(86) PCT No.: PCT/EP2006/006372

§ 371 (c)(1),
(2), (4) Date: Aug. 13, 2008

(87) PCT Pub. No.: WO2007/003368

PCT Pub. Date: Jan. 11, 2007

(65) Prior Publication Data

US 2009/0306826 A1 Dec. 10, 2009

(30) Foreign Application Priority Data

Jul. 1, 2005 (DE) ..... 10 2005 030 860

(51) Int. Cl.
*G06F 19/00* (2011.01)
*E02D 3/02* (2006.01)
*E01C 19/30* (2006.01)

(52) U.S. Cl. ..... 700/275; 405/271; 404/133.05

(58) Field of Classification Search ..... 700/19, 700/275, 65, 170, 280; 404/133.05, 133.1; 405/271
See application file for complete search history.

(56) References Cited

U.S. PATENT DOCUMENTS 6,846,128 B2 * 1/2005 Sick ..... 404/133.05
2006/0193693 A1 * 8/2006 Congdon ..... 404/133.05

FOREIGN PATENT DOCUMENTS

DE 100 53 446 A1 6/2002
GB 805 643 A 12/1958

* cited by examiner

*Primary Examiner* — Charles Kasenge
(74) *Attorney, Agent, or Firm* — Boyle Fredrickson, S.C.

(57) ABSTRACT

A vibrating plate system comprises at least two vibrating plates are mechanically coupled to one another via a coupling device and a controlling transmitter for outputting control data to the vibrating plates. Each of the vibrating plates comprises a receiving device for receiving the control data, a drive mechanism for propelling the vibration plate forwardly and rearwardly, and a position determining device for determining the position of the relevant vibrating plate within the group. A rule memory is also provided in which control rules are stored. One control rule defines a correlation between a control measure for controlling the traveling mechanism according to the position of the vibrating plate and an item of control information given by the control data. In each vibrating plate, a single control device selects a suitable control rule according to the position of the vibrating plate and to the control measure.

19 Claims, 4 Drawing Sheets

| | Control Information | | | | |
|---|---|---|---|---|---|
| | Left | Straight Ahead | Right | Back | Stand |
| A | - | + | + | - | 0 |
| B | 0, + | + | 0, + | - | 0 |
| C | + | + | - | - | 0 |

Control Information:

+ = Forward Travel

- = Backward Travel

0 = Stationary Vibration

Fig. 2

VIBRATING PLATE SYSTEM

BACKGROUND OF THE INVENTION

1. Field of the Invention

The present invention relates to a vibrating plate system having an assembly of at least two vibrating plates that are mechanically coupled to one another via a coupling device.

2. Description of the Related Art

Vibrating plates used as soil compaction devices standardly have a lower mass that has a soil contact plate that is acted on by a vibration exciter, as well as an upper mass that is capable of elastic motion relative to the lower mass and that carries a drive for the vibration exciter. Such vibrating plates have proven to be outstandingly effective for soil compaction in practice.

However, for larger surface compaction jobs, larger roller compactors are preferably used that have two vibrating rollers and, compared with a single vibrating plate, produce a higher output per surface area. Due to their high static weight, however, these roller compactors cannot be used for all cases of application.

In order to enable the production of a similarly high output per surface area with vibrating plates, it is known to mechanically couple individual vibrating plates to one another with the aid of a coupling device to form an assembly. If, for example, two or three vibrating plates are to be connected alongside one another, twice or three times the working width can be achieved thereby. Such an assembly of a plurality of vibrating plates is known for example from GB-A-944 922.

DE-A-100 53 446 also describes various possibilities for connecting vibrating plates to form an assembly. Although this publication already describes a very highly developed control concept for the remote operation of a vibrating plate system formed by an assembly of a plurality of vibrating plates, it is desirable to further develop these concepts. In particular, it is of interest to keep the control outlay of software and hardware that additionally results from the assembly of a plurality of vibrating plates as low as possible, in order to avoid unnecessarily increasing the overall cost of the assembly.

OBJECT OF THE INVENTION

Therefore, the object of the present invention is to indicate a vibrating plate system of a plurality of vibrating plates mechanically coupled to one another, in which vibrating plates having a relatively simple construction can be controlled together without unnecessary control expense.

According to the present invention, this object is achieved by a vibrating plate system according to Claim 1. Advantageous further developments of the present invention are indicated in the dependent claims.

A vibrating plate system according to the present invention has an assembly of at least two vibrating plates that are mechanically coupled to one another via a coupling device, and a controller for outputting control data to the vibrating plates. Each of the vibrating plates has in turn a receiver device for receiving the control data and a drive mechanism that is intended to enable at least forward and backward travel of the vibrating plate. It is not necessary for the individual vibrating plate to be steerable. Rather, the coupling according to the present invention of the vibrating plates to form the assembly makes it possible to steer the assembly as a whole.

In addition, for each vibrating plate a position-determining device is provided for determining the position of the relevant vibrating plate within the assembly. With the position-determining device, it is possible to determine precisely at which location the relevant vibrating plate is located. If, for example, three vibrating plates are coupled alongside one another, one vibrating plate is at the left, the second is in the center, and the third is at the right. Analogously, three vibrating plates can be coupled one after the other, so that the first vibrating plate is in front, the second is in the center, and the third is in the rear. In this way, it is possible for each vibrating plate to "know" which position it has assumed within the assembly.

In addition, according to the present invention there is provided for each vibrating plate a control storage unit in which the control rules are stored. A control rule defines a relation between a control measure for controlling the drive mechanism of these vibrating plates (e.g. travel in the forward direction, travel in the backward direction) dependent on the position of the vibrating plate and an item of control information given by the control data. In addition, each vibrating plate has a control device for selecting an appropriate control rule dependent on the position of the vibrating plate and on the item of control information, as well as for controlling the drive mechanism in a manner corresponding to the control rule.

The control storage device can for example be present in the form of a value table. For this purpose, particular control measures for the drive mechanism of the relevant vibrating plate are stored that are to be carried out dependent on the previously defined or determined position of the vibrating plate, within the assembly, and dependent on the received control data. Because, the individual vibrating plate knows the position at which it is situated in the vibrating plate system, with the aid of the rule storage device it can select the correct control rule whenever an item of information comes from the controller.

For general forward or backward travel, the knowledge of the position of the individual vibrating plate will normally not play a role. However, this information is of interest in the case of curved travel or rotation. Given an assembly of three vibrating plates, a rotation in place is possible when one of the outer vibrating plates (e.g. the left one) carries out forward travel while the other outer vibrating plate (the right one) carries out backward travel, and the center vibrating plate does not travel. In this way, a kind of "tank controlling" is possible by which the vibrating plate system as a whole can be controlled very easily.

Of course, the center vibrating plate can in addition also be moved in the forward or backward direction, so that overall a curved path is achieved.

Preferably, the controller has a remote-control transmitter device, so that the controller and the receiver device are components of a radio, cable, or infrared remote control system. In practice, an infrared remote controlling can offer advantages, because with such a system particular known safety requirements are easily fulfilled.

In a particularly preferred specific embodiment of the present invention, each of the vibrating plates has a transmitter device for transmitting control data that were previously outputted by the controller and received by the receiver. This means that first each of the vibrating plates receives, with the aid of its receiver device, the control data from the controller. Subsequently, each of the vibrating plates forwards the received control data, e.g. according to a predetermined time scheme, so that the vibrating plates can exchange and match the control data among themselves. In this way, it is possible for a travel motion to be executed only when a matching of the received control data has taken place. Only when all the vibrating plates have received the same control information from the controller is it certain that this control action is actually to be carried out. Only then is the corresponding item of control information implemented by the respective control devices, in the form of individual control measures for each individual vibrating plate.

The transmit devices of the vibrating plates can preferably be components of a radio path, close-range radio path (Bluetooth), or infrared path. In addition, it is possible to create a cable connection between the vibrating plates.

Alternatively, the controller can also transmit the control data to at least one of the vibrating plates via a cable. These control data are then also to be transmitted from the one vibrating plate to the rest of the vibrating plates, so that all vibrating plates have the same "information status."

Accordingly, it is particularly advantageous that an exchange of data takes place between the vibrating plates, via their transmit and receive devices, regarding the control data received by the vibrating plates. Here, for each vibrating plate a matching device is provided for comparing the control data received at this vibrating plate, namely for comparing the control data sent by the controller with the control data sent by the other vibrating plates. Here, what is decisive is of course solely which control data has been received by the relevant vibrating plate, because the individual vibrating plate cannot obtain knowledge of the actually sent control data in any other way. If, for example, there is a transmission error on the transmission path between the central controller and the vibrating plate, the plate will receive errored control data without, in some circumstances, knowing that this is the case. The deviation will be determined only through the matching of these already-received control data with the data sent by the other vibrating plates, so that the corresponding consequences can be realized. This includes, for example, the setting of the vibrating plate to standstill, or the setting of the other vibrating plates to standstill as well.

It is not necessary for each of the vibrating plates to communicate with every other vibrating plate in the assembly. Rather, it can also be sufficient for one vibrating plate to exchange data only with one other, or at most two other, vibrating plates. For example, a closed chain can be formed so that in each case a vibrating plate sends information to only one additional vibrating plate, until, forwarded via a plurality of vibrating plates, the information finally returns to the original vibrating plate and the "information chain" is closed.

In a particularly advantageous specific embodiment of the present invention, the controller predetermines a clock pulse, and, during a first clock pulse, sends the control data as a control telegram that is received by the receiver devices of the vibrating plates. During the following clock pulses, each of the vibrating plates, via its transmitter device and dependent on its position, sends the received control telegram to the other vibrating plates one after the other in a clock pulse allocated to the relevant vibrating plate. This means that the vibrating plates, one after the other, repeat the control telegram received by the controller, and send it to the remaining vibrating plates. In this way, each vibrating plate acknowledges recognition of the control telegram it has received.

Instead of the clocked successive transmission of the control data in the form of control telegrams, it is alternatively also possible for the control data to be transmitted simultaneously; here, either a particular coding form is selected or the transmission takes place on different transmit frequencies. It is then possible for example for all the control data to be sent and received essentially permanently, the data being differentiated with respect to their transmit frequency. It is also possible to install a bus system or a local network (e.g. Ethernet) in a simplified manner in order to exchange the data in the form of data packets.

For each vibrating plate, a matching device is provided with which the control telegrams sent by the controller and by the other vibrating plates and received at this vibrating plate can be compared during a cycle of clock pulses. The matching device thus compares, in each clock pulse, whether the control telegram received by the vibrating plate with which the matching device is associated agrees with the control telegrams received by the other vibrating plates. In case of deviations, corresponding security measures can be taken. Only when there is agreement between the various control telegrams are the control measures derivable therefrom and desired by the operator carried out.

A cycle of clock pulses begins with a clock pulse for the transmission of the control telegram by the controller. It ends with the clock pulse for the transmission of the control telegram by the last vibrating plate. After this there takes place a new cycle that is introduced with the transmission of a control telegram by the controller.

Of course, it is not necessary for the operator to keep to the clock pulse. Rather, the operator can permanently press a corresponding operating button or lever on the controller. The clock pulse is then automatically generated by the controller, which, in the manner described above, first sends out a control telegram and then pauses during a corresponding number of clock pulses, during which the vibrating plates are able to send out their control telegrams one after the other in a predefined manner.

Preferably, the matching device gives a stop command to the control device of the vibrating plate allocated to it if the received control telegrams deviate from one another during a cycle of clock pulses. In this way, the control device stops the drive mechanism, so that the vibrating plate enters a safe state. Danger to objects or persons in the vicinity of the vibrating plate is then excluded.

Optionally, it is possible for the matching device to supply a stop command to either only the control device of its own vibrating plate, or to the overall vibrating plate system.

The stopping of the drive mechanism can comprise reduction of the rotational speed of a drive motor and/or the reduction of vibrations used for the advance of the vibrating plate as well as for soil compaction. The stop command can for example set a drive motor on the respective vibrating plate into no-load rotation, in which it no longer drives the drive mechanism.

Conversely, the matching device gives a travel command to the control device whenever the received control telegrams are identical. The control device can thereupon correspondingly control the control telegrams, and the control rules connected therewith, so that the vibrating plate system can travel in the desired manner.

In a particularly advantageous further development of the present invention, a close-range recognition device is provided in order to produce a stop command for the control devices of all vibrating plates of the vibrating plate system whenever a prespecified minimum distance between the controller and the assembly of vibrating plates is undershot. In DE-A-42 21 793 and DE 101 16 526 B4, infrared remote control devices for self-powered tools are described that have such a close-range recognition system. Thus, from DE-A-42 21 793 it is known that a control device carried by the operator can additionally send out, besides the infrared control radiation provided for the functional controlling of the tool, an infrared close-range radiation that has an intensity that is significantly lower than that of the control radiation. In this way, this close-range radiation can be received with sufficient intensity only in the immediate vicinity of the transmitter. When this close-range radiation is received, in the receive unit on the vibrating plate the production of electrical signals caused by the control radiation is suppressed, which would otherwise bring about the travel of the tool. With this infrared remote controlling, the tool can be operated as long as it is situated within the receive range of the control radiation, but outside the range of the close-range radiation. If a prespecified safety distance between the operator and the tool is undershot, i.e., the close-range radiation is received by the receive unit attached to the tool, the tool is shut off.

Such a close-range recognition device is also useful in the present vibrating plate system in order to prevent the operator from approaching too close to the vibrating plate system. If the operator, carrying the controller, comes closer than the predetermined minimum distance, the vibrating plate system is set to standstill.

Preferably, the drive mechanism is formed by a vibration exciter. Such a vibration exciter standardly has for example two parallel imbalance shafts that rotate in opposite directions and whose phase position relative to one another can be modified. During the opposite rotation of the imbalance shafts, there arises a resultant force vector of the vibrations that, depending on the phase position in the direction of travel of the vibrating plate, can be inclined forward or backward. Suitable synchronization of the imbalance masses also permits what is called stationary vibration to be set, in which the resultant force vector is oriented vertically.

For the vibrating plate system according to the present invention, it is not necessary that the individual vibrating plates be steerable. Rather, it is sufficient that the vibrating plates merely be capable of travel in the forward and backward direction. Of course, is also possible to use vibrating plates that are steerable in the vibrating plate system. In this case, the steering mechanism should then however preferably be blocked or taken out of operation, so that the vibrating plates can actually travel only in the forward and backward direction.

The vibrating plates are preferably connected essentially rigidly by the coupling device. However, the coupling device can also have elastic elements, such as for example rubber cushions, that permit a certain degree of movability of the vibrating plates relative to one another.

A completely rigid coupling of the vibrating plates would result in a behavior of the vibrating plate system that is comparable to that of a rigid roller. Small irregularities in the surface to be compacted would be evened out with this rigid coupling. However, in this case, as is also the case with compacting rollers, troughs would remain uncompacted.

However, to the extent that a certain degree of relative movability is provided by elastic elements such as rubber cushions, the vibrating plates can individually adapt to the ground over which they travel, and can "cling" to this contour, in particular if the ground is not completely flat.

The coupling device can for example be screwed onto the existing protective frame of the vibrating plates; for this, a sufficient number of coupling bearers connecting the vibrating plates should be provided.

Via the elastic elements, the vibrating plates can assume an angle relative to one another that is limited by the allowable deformability of the elastic elements (rubber cushions).

These and additional advantages and features of the present invention are explained in more detail below on the basis of an example, with the aid of the accompanying Figures.

BRIEF DESCRIPTION OF THE DRAWINGS

FIG. 2 shows a table with control rules;

DETAILED DESCRIPTION OF THE PREFERRED EMBODIMENT

Figure 1:
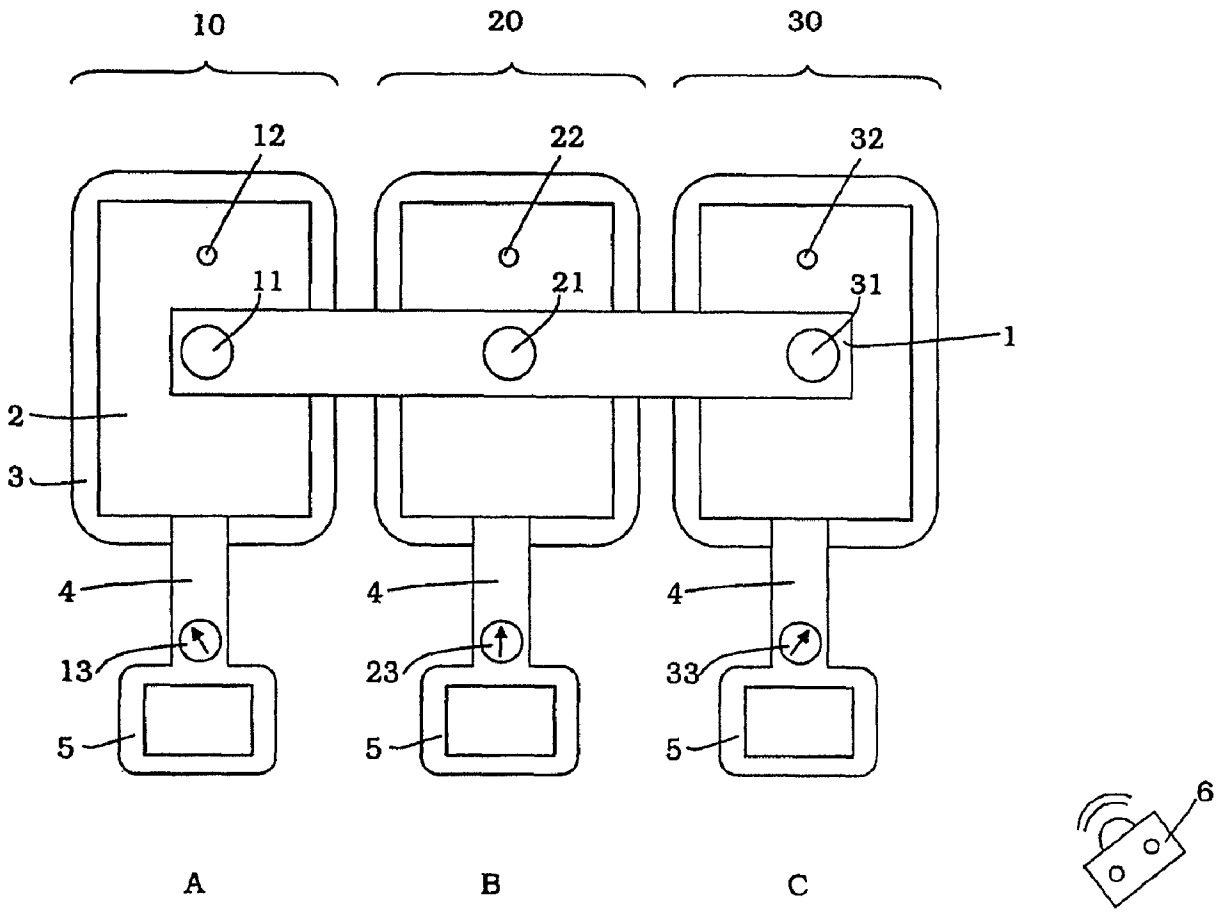
FIG. 1 shows a vibrating plate system according to the present invention in a schematic top view.

FIG. 1 shows a schematic top view of a vibrating plate system according to the present invention that has three vibrating plates that are mechanically couple d to one another to form an assembly, namely a first vibrating plate A. (reference character 10), a second vibrating plate B (reference character 20), and a third vibrating plate C (reference character 30).

Vibrating plates 10, 20, 30 are coupled to one another via a coupling device. The coupling device has a coupling bearer 1 that can be formed for example by a steel square tube, a steel bearer, or the like. Further components of the coupling device are rubber cushions 11, 21, and 31, via which coupling bearer 1 is fastened to vibrating plates 10, 20, 30. It is also possible for more coupling bearers 1 to be provided as needed.

Coupling bearer 1 accordingly ensures an essentially rigid connection of vibrating plates 10, 20, 30 to one another. In particular, the vibrating plates are held parallel to one another in the direction of travel. However, in order to enable adaptation to smaller irregularities in the soil during the travel of the overall vibrating plate system, vibrating plates 10, 20, 30 are capable of being moved relative to one another, due to the coupling via rubber cushions 11, 21, 31, within limits determined by the elasticity and deformability of rubber cushions 11, 21, 31. In this way, vibrating plates 10, 20, 30 can rotate about the three spatial axes relative to their fastening point on coupling bearer 1. This movability makes it possible for the vibrating plate system to adapt to uneven soil and to equalize smaller obstacles. This results in an improved compaction behavior in comparison with a rigid roller. If vibrating plates 10, 20, 30 are connected via a plurality of coupling bearers 1, the relative movability is greatly limited.

In FIG. 1, the coupling device is shown only on the basis of an example. Of course, many other variants are easily conceivable in which a plurality of vibrating plates are mechanically coupled to one another to form an overall system. Thus, it is for example also possible to achieve the vibrating plates through a mechanical coupling of the shafts (see shaft 4, explained below). Vibrating plates 10, 20, 30 can also be coupled to one another at their respective end surfaces.

Each of vibrating plates 10, 20, 30 is made up, in a known manner, of an upper mass 2 that has a drive (e.g. an internal combustion engine) and a lower mass 3 that is capable of elastic movement relative to upper mass 2 and that has a soil contact plate and a vibration exciter that acts on the soil contact plate. One example of a vibration exciter was already described above with reference to the prior art. The vibration exciter used in the present invention does not differ from known vibration exciters. In particular, what is known as a two-shaft exciter is used in which two imbalance shafts situated parallel to one another rotate in directions opposite to one another with a positive fit, thus producing a resultant vibrating force. The resultant force not only causes a vibration for soil compaction, but simultaneously also brings about a drive effect in the direction of travel (forward or backward), given a corresponding phase position of the imbalance shafts to one another. The phase position of the imbalance shafts should therefore be capable of being modified using a known phase adjustment device.

Alternatively to the setting of the phase position, it is also possible to achieve a modified force effect by modifying the rotational speed of one of the drives or all of the drives.

The vibration exciter thus also forms the drive mechanism for the individual vibrating plate.

In the vibrating plate systems in FIG. 1, as an example each of vibrating plates 10, 20, 30 is equipped with a shaft 4; at the end of each such shaft there is provided a handle 5 and, if necessary, control elements for controlling the drive on upper mass 3 or for modifying the phase position of the imbalance shafts in the vibration exciter. Shafts 4 and handle 5 can be used by the operator to manually guide a vibrating plate when vibrating plates 10, 20, 30 are not connected by coupling bearer 1. To this extent, each of vibrating plates 10, 20, 30 can also advantageously be used by itself. The vibrating plate system according to the present invention is formed only through the coupling with the aid of coupling bearer 1. Due to the high overall mass of the vibrating plate system, it is then useful to fold up shafts 4, because in this operating state they are without function and can no longer be usefully used by the operator due to the excessive manual forces required.

The controlling of the vibrating plate system preferably takes place via remote control, e.g. a radio or infrared remote controlling. In the example according to FIG. 1, an infrared remote control is shown to which there belongs a controller 6 that acts as a transmitting device and receiver devices 12, 22, 32, allocated respectively to vibrating plates 10, 20, 30, and fashioned for example as infrared eyes.

Via buttons, switches, or levers on controller 6, the operator can input his desired commands which are then supplied as control data to vibrating plates 10, 20, 30 via the infrared path, and are received there by receiver devices 12, 22, 32. The control data are subsequently supplied to a control device (not shown) in each of vibrating plates 10, 20, 30.

In practice, it has turned out that a simple mechanical coupling of vibrating plates 10, 20, 30 with the aid of coupling bearer 1 results in a vibrating plate system that places very high demands on the operator during controlling, and at the same time requires a high degree of bodily exertion.

As stated above, it is desirable for each of the vibrating plates also to be capable of being operated by itself Correspondingly, each vibrating plate 10, 20, 30 has its own gas lever for the drive motor. In models in which the transmission of force from the drive motor to the vibration exciter takes place via a centrifugal clutch, the gas levers on vibrating plates 10, 20, 30 are pulled one after the other, or the direction control levers are actuated one after the other, so that one vibrating plate already begins to move before the other vibrating plates are brought up to speed. In this way, the overall system then moves from the beginning in an undefined direction that is not desired by the operator.

In addition, it is very difficult for the operator to carry out changes in direction of the vibrating plate, system. As already stated, the vibrating plate system has a mass that is large enough that a manual correction of the direction of travel is very strenuous. For the controlling of the drive mechanisms (vibration exciters) in the individual vibrating plates in remote control operation, the operator would have to have a plurality of remote control devices that he would have to operate simultaneously in an extremely skillful manner in order to achieve the desired travel behavior.

In contrast, in the vibrating plate system according to the present invention a single controller is sufficient for the controlling. On the controller, the required operating elements are provided with which for example forward travel, backward travel, travel to the left, travel to the right, and stationary vibration can be specified, as the operator would do in the case of a single vibrating plate. The vibrating plate system behaves in a manner corresponding to the instructions of the operator.

For this purpose, controller 6 transmits, e.g. in the form of infrared signals, the control data as control telegrams to all three vibrating plates 10, 20, 30, where they are received by receiver devices 12, 22, 32.

According to the present invention, each vibrating plate 10, 20, 30 has a position-determining device 13, 23, 33. In the example shown in FIG. 1, position-determining devices 13, 23, 33 are attached to the ends of each shaft 4 in the form of rotary switches. Alternatively, switches, buttons, coders, etc. can be used. What is important is that each of vibrating plates 10, 20, 30 obtains information concerning the position at which it is situated in the assembly.

Instead of switches, it is also possible to have position-determining devices 13, 23, 33 operate automatically. For example, each of position-determining devices 13, 23, 33 can be equipped with a GPS system with which, via evaluation of satellite signals, a very precise determination of position in an earth coordinate system is possible.

It is also possible to determine, based on the positions of the position-determining devices relative to one another, which of the position-determining devices is in the center, which is at the left, and which is at the right (given three vibrating plates). Here, runtime differences of signals can also be evaluated.

With the automatic position-determining devices, each of the vibrating plates is itself able to automatically determine its position within the assembly.

Accordingly, in the example shown in FIG. 1 the rotary switch that acts as position-determining device 13 is placed in a position that corresponds to the information "left." Correspondingly, vibrating plate 10 knows that it is situated at the left position in the three-part assembly. Correspondingly, rotary switch 23 of vibrating plate 20 is set to the position "center," while rotary switch 33 of vibrating plate 30 is set to "right."

The example shown in FIG. 1 indicates only one specific embodiment of a vibrating plate system according to the present invention. Of course, other arrangements, e.g. having two, four, or more vibrating plates, are also possible. In addition, it is not necessary that the vibrating plates be arranged in a row next to one another. The vibrating plates can also be placed in several rows one in front of the other or one behind the other. For example, a type of "Christmas tree" arrangement may be selected in order to achieve a particularly strong soil compaction.

In each of these cases, it is necessary for each individual vibrating plate to "know" at which position it is situated in the assembly.

In addition, each of vibrating plates 10, 20, 30 has a rule storage device that is preferably provided in the control device. Particular control rules, e.g. in the form of a value table, are stored in this storage device.

A control rule defines a relationship between a controlling measure for controlling the drive mechanism (phase position of the imbalance shafts in the forward or backward direction) dependent on the control information obtained by controller 6 and dependent on the position of the vibrating plate. Thus, the individual vibrating plate knows not only which items of control information (desired controlling) have been sent out by the operator using controller 6. It also knows, as stated above, the position of the vibrating plate within the overall assembly, and can accordingly select from the rule storage device the control rule that is appropriate for this specific case of application.

Correspondingly, the control device selects, dependent on the position of the vibrating plate and the control information, the prespecified control rule, and controls the drive mechanism/vibration exciter in a manner corresponding to this control rule.

FIG. 2 shows a table of control rules. Such a value table is stored for example in each of vibrating plates 10, 20, 30 as a rule storage device. Individual vibrating plates 10, 20, 30 are entered in the table as vibrating plates A, B, C. Corresponding to the representation in FIG. 1, vibrating plate A is situated at the left, vibrating plate B is in the center, and vibrating plate C is at the right. This position information is known to vibrating plates A, B, C. For each of vibrating plates A, B, C, there result from the table in FIG. 2 control measures for the drive mechanism or for the vibration exciter, dependent on the control information that was sent out by controller 6.

If the operator wants the vibrating plate system to travel straight ahead, the drive mechanisms of all three vibrating plates A, B, C are set to forward travel (symbol "+"). The same holds conversely for backward travel (symbol "−"). In the case of stationary vibration (symbol "○"), the vibration exciters in the individual vibrating plates are set in such a way that they do not produce any drive, but rather produce only a vertical vibration.

Of interest are the control measures in the case of travel to the left or to the right. In the case of travel to the left of the vibrating plate system, the vibrating plate situated at the left, i.e. vibrating plate A, is to move toward the rear in order to enable the smallest possible curve radius. Correspondingly, the vibration exciter in vibrating plate A receives the control command "−" (backward travel). Vibrating plate C, situated at the outside on the right, should in contrast travel forward (control measure "+"). For the vibrating plate in the center, depending on the operator's wishes a stationary vibration "0" or a forward travel "+" can be set; the former produces rotation in place and the latter produces an extended curve to the left. For this purpose, for example the position of a joystick on controller 6 can also be decisive.

Because, as stated, the control rules are stored in the rule storage, device in each of vibrating plates 10, 20, 30, and each of the vibrating plates knows its own position within the assembly, it is also possible for each of the vibrating plates to derive the corresponding decisive control rules and to control its own vibration exciter in the desired manner.

The transmission of the control data via an infrared path always requires a good line-of-sight connection between the transmitter (controller 6) and receiver devices 12, 22, 32. Nonetheless, disturbances in the signal transmissions are also possible. In order to ensure that all vibrating plates 10, 20, 30 have received the same control information from controller 6, so that the vibrating plate system can actually behave in the manner desired by the operator, a constant matching of the received control data takes place through the exchange of data between vibrating plates 10, 20, 30.

Figure 3:
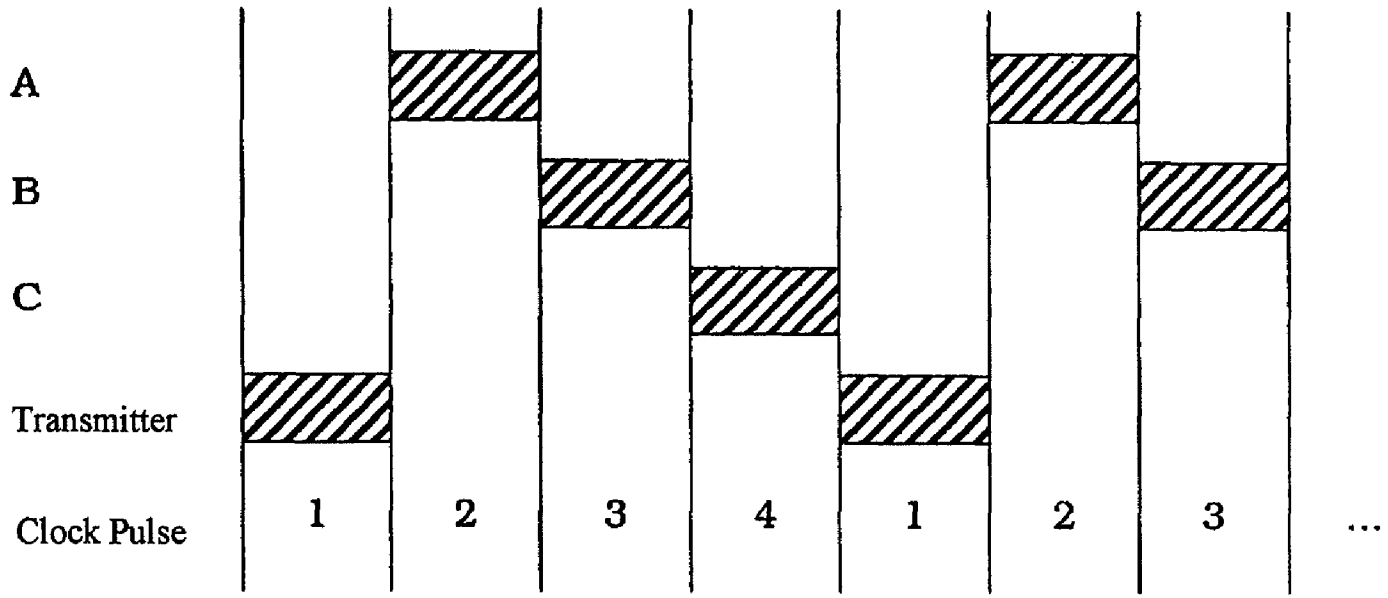
FIG. 3 shows a schema with control telegrams sent out in pulses.

FIG. 3 shows an example of such an exchange of data.

Controller 6, acting as transmitter, determines a clock pulse for the data exchange. During a first clock pulse (pulse 1 in FIG. 3), controller 6 sends the control data in a block as a control telegram (hatched column). The control telegram is received by receiver devices 12, 22, 32 of vibrating plates 10, 20, 30.

During the following clock pulses 2 to 4, vibrating plates 10, 20, 30 (or A, B, C) send, one after another, the control telegram that they each previously received from controller 6. For this purpose, each of vibrating plates 10, 20, 30 has its own transmitter device, which is preferably integrated into receiver device 12, 22, 32 in order to keep the constructive expense low.

As FIG. 3 shows, vibrating plate A sends its control telegram in the second pulse, while vibrating plate B sends in the third control pulse and vibrating plate C sends in the fourth control pulse the respective control telegram that each of these plates received previously in the first pulse from controller 6.

Parallel to this, there takes place in each vibrating plate a comparison of the control telegrams received in pulse 1 from controller 6 and those received in the following pulses from the other vibrating plates. For this purpose, a corresponding matching device can be provided in the control device.

If one of vibrating plates 10, 20, 30 determines that the control telegrams do not agree with one another, it infers from this fact that there is a communication problem. It thereupon places the vibrating plate automatically into a safe state, e.g. stationary vibration or standstill, in which the drive motor runs in no-load rotation. The other vibrating plates will correspondingly also determine deviations in the control telegrams, and will also enter safe states. Alternatively, it is also possible for a vibrating plate to send a stop signal to the other vibrating plates after it has determined a deviation in the control telegrams.

If, in contrast, vibrating plates 10, 20, 30 determine that the received control telegrams agree with one another, they can take the required control measures, e.g. corresponding to the control rules according to the table in FIG. 2.

The control telegrams received or transmitted during a cycle are compared. In the normal case, a cycle is defined by the number of vibrating plates in the vibrating plate system plus controller 6. Correspondingly, for the vibrating plate system shown in FIG. 1, a cycle has four clock pulses, as shown in FIG. 3. After the conclusion of a cycle of four pulses, controller 6 sends out a new control telegram, whereupon the vibrating plates continue with the data matching. The clock pulses can be kept very short, e.g. in the range of seconds or milliseconds.

Figure 4:
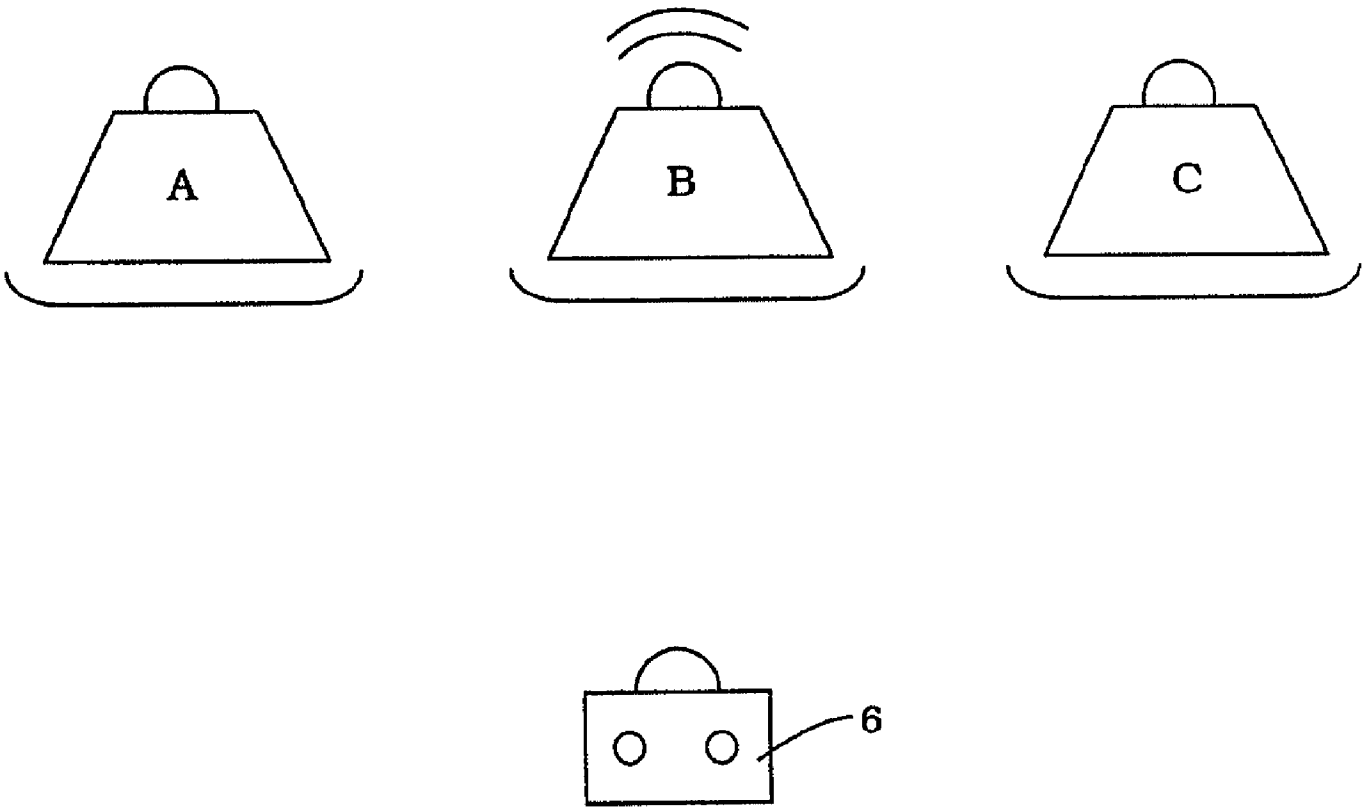
FIG. 4 shows the state of the vibrating plate system during a particular clock pulse.

In addition, FIG. 4 shows the behavior of the vibrating plate system for the example of pulse number 3 shown in FIG. 3. At this time, only vibrating plate B is transmitting, while controller 6 and vibrating plates A, C are not transmitting. However, vibrating plates A and C are set to receive so that they can receive and evaluate the control telegram from vibrating plate B.

Up to now, essentially vibrating plate systems according to the present invention have been described in which a communication takes place between all the vibrating plates in order to match information. However, it is also possible for a matching of information to be carried out only between adjacent vibrating plates. Vibrating plate 20, situated in the center in a three-part assembly (FIG. 1), would then however also have to communicate with both adjacent vibrating plates 10, 30. In contrast, vibrating plates 10, 30 situated at the outside would not communicate with one another, but rather would communicate only with vibrating plate 20 situated in the center.

As stated above, each of vibrating plates 10, 20, 30 can also be used individually outside the assembly. Because vibrating plates 10, 20, 30 do not have to be steerable, they can then also not be controlled via a remote controlling. Rather, the steering takes place exclusively via shaft 4 and handle 5. In individual operation, receive device 12, 22, 32 with the integrated transmitter does not function for the data exchange.

The vibrating plate system according to the present invention can be controlled easily and reliably on the basis of the unified controller, the control rules stored individually in the vibrating plates, and the optional data matching. Particularly advantageously, the controlling can also be supplemented by a travel direction stabilization, described for example in DE-A-100 53 446. Accordingly, a movement acquisition device can be provided either for each of the vibrating plates or in a unified fashion for the overall vibrating plate system (e.g. situated on coupling bearer 1), in order to acquire an actual value for the travel movement of the vibrating plate system. In a travel regulation device, the actual value is compared with a target value specified by the operator. The target value is present as control information from controller 6. If a difference is determined, the travel regulation device corrects the travel movement by sending corresponding control telegrams to vibrating plates 10, 20, 30. An arrangement must be provided to the extent that the control commands of the travel regulation device supplement or may even interfere with the control commands from controller 6. This can be done for example by transmitting the control signals in different frequency ranges. However, while in DE-A-100 53 446 the travel regulation device is used to control the individual drive mechanisms in order to steer the overall vibrating plate system, now only one unified item of control information is supplied to the overall assembly of vibrating plates. Each of the individual vibrating plates then knows how it has to behave in order to be able to fulfill the specification of the travel regulation device that is decisive for the overall system (travel to the left, travel to the right, travel straight ahead, etc.).

The travel regulation device can be provided for example on only one of the vibrating plates. Alternatively, however, it can also be provided independent of the assembly, and thus can externally compare the actual value of the travel motion with the operator's wishes.

The invention claimed is:

1. A vibrating plate system, comprising:

an assembly of at least two vibrating plates that are mechanically coupled to one another via a coupling device; and a controller for outputting control data to the vibrating plates;

each vibrating plate including:

a receiver device for receiving the control data from the controller;

a drive mechanism for advancing the vibrating plate forwardly and backwardly;

a position-determining device for determining the position of a relevant vibrating plate within the assembly;

a rule storage device in which control rules are stored, a control rule defining a relation between a control measure for controlling the drive mechanism of the relevant vibrating plate dependent on the position of that vibrating plate and an item of control information given by the control data; and a control device for selecting an appropriate control rule dependent on the position of the relevant vibrating plate and on the control information, and for controlling the drive mechanism of the relevant vibrating plate in a manner corresponding to the control rule.

2. The vibrating plate system as recited in claim 1, wherein the controller has a remote control transmitter device.

3. The vibrating plate system as recited in claim 1, wherein the controller and the receiver device are components of at least one of a radio remote control system and a cable remote control system.

4. The vibrating plate system as recited in claim 1, wherein the controller and the receiver device are components of an infrared remote control system.

5. The vibrating plate system as recited in claim 1, wherein each of the vibrating plates has a transmitter device for transmitting control data that were previously outputted by the controller and received by the receiver device.

6. The vibrating plate system as recited in claim 5, wherein the transmitter device is a component at least one of a radio path, a close-range radio path, a cable path, and an infrared path.

7. The vibrating plate system as recited in claim 1, wherein a close-range recognition device is provided for producing a stop command for the control devices of all the vibrating plates if a prespecified minimum distance between the controller and the assembly of vibrating plates is undershot.

8. The vibrating plate system as recited in claim 1, wherein the drive mechanism is formed by a vibration exciter.

9. The vibrating plate system as recited in claim 1, wherein the vibrating plates are essentially rigidly connected to one another by the coupling device.

10. The vibrating plate system as recited in claim 1, wherein the coupling device has elastic elements that permit the vibrating plates to be capable of movement relative to one another.

11. The vibrating plate system as recited in claim 1, wherein each vibrating plate additionally comprises an internal combustion engine for supplying power to the associated drive mechanism.

12. A vibrating plate system, comprising:

an assembly of at least two vibrating plates that are mechanically coupled to one another via a coupling device; and a controller for outputting control data to the vibrating plates;

each vibrating plate including:

a receiver device for receiving the control data from the controller;

a drive mechanism for advancing the vibrating plate forwardly and backwardly;

a position-determining device for determining the position of a relevant vibrating plate within the assembly;

a rule storage device in which control rules are stored, a control rule defining a relation between a control measure for controlling the drive mechanism of the relevant vibrating plate dependent on the position of that vibrating plate and an item of control information given by the control data;

a control device for selecting an appropriate control rule dependent on the position of the relevant vibrating plate and on the control information, and for controlling the drive mechanism of the relevant vibrating plate in a manner corresponding to the control rule, wherein each of the vibrating plates has a transmitter device for transmitting control data that were previously outputted by the controller and received by the receiver device; and an exchange of data takes place between the receiver device of the vibrating plates, via their transmitter and receiver devices, regarding the control data received by the vibrating plates; and for each vibrating plate, a matching device is provided for comparing the control data sent by the controller and by the other vibrating plates, and received by that vibrating plate.

13. The vibrating plate system as recited in claim 12, wherein the controller specifies a clock pulse;

during a first clock pulse, the controller sends the control data as a control telegram that is received by the receiver devices of the vibrating plates;

during the following clock pulses, via a transmitter device, each of the vibrating plates sends the received control telegram to each of the other vibrating plates, one after the other, and dependent on its position, in a clock pulse allocated to the relevant vibrating plate;

at each vibrating plate, the matching device is used to compare the control telegrams sent by the controller and by the other vibrating plates and received at that vibrating plate during a cycle of clock pulses.

14. The vibrating plate system as recited in claim 13, wherein a cycle begins with the clock pulse for transmitting the control telegram from the controller, and ends with the clock pulse for transmitting the control telegram from the last vibrating plate.

15. The vibrating plate system as recited in claim 12, wherein the controller sends the control data as a control telegram that is received by the receiver devices of the vibrating plates, and wherein the matching device in the respective vibrating plate sends a stop command to the control device if the received control telegrams differ from one another, so that the control device stops the drive mechanism.

16. The vibrating plate system as recited in claim 15, wherein the stopping of the drive mechanism comprises the reduction of at least one of the rotational speed and the reduction of vibrations that are used for the advance of the vibrating plate.

17. The vibrating plate system as recited in claim 12, wherein the controller sends the control data as a control telegram that is received by the receiver devices of the vibrating plates, and wherein the matching device sends out a travel command to the control device if the received control telegrams are identical; and the control device controls the drive mechanism in a manner corresponding to the control telegrams and to the control rules connected therewith.

18. A vibrating plate system, comprising:

an assembly of at least two vibrating plates that are mechanically coupled to one another via a coupling device and operable in concert with one another, each of the at least two vibrating plates being decoupled from the other vibrating plate and usable by itself when it is decoupled from the other vibrating plate; and a controller for outputting control data to the vibrating plates;

each vibrating plate including:

a receiver device that receives the control data from the controller;

a drive mechanism that advances the vibrating plate forwardly and backwardly;

an internal combustion engine that supplies power to the drive mechanism;

a position-determining device that determines the position of a relevant vibrating plate within the assembly;

a rule storage device in which control rules are stored, a control rule defining a relation between a control measure for controlling the drive mechanism of the relevant vibrating plate dependent on the position of that vibrating plate and an item of control information given by the control data; and a control device that selects an appropriate control rule dependent on the position of the relevant vibrating plate and on the control information, and that controls the drive mechanism of the relevant vibrating plate in a manner corresponding to the control rule.

19. The vibrating plate system as recited in claim 18, wherein each of the at least two vibrating plates includes an engine and a vibration exciter that can cause a vibration for (i) soil compaction, and (ii) providing a drive effect.

* * * * *